US006457715B1

(12) United States Patent
Friedman

(10) Patent No.: US 6,457,715 B1
(45) Date of Patent: Oct. 1, 2002

(54) METHODS FOR PLAYING WAGERING GAMES

(75) Inventor: Stacy A. Friedman, San Francisco, CA (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/618,958

(22) Filed: Jul. 19, 2000

Related U.S. Application Data

(60) Provisional application No. 60/145,555, filed on Jul. 23, 1999.

(51) Int. Cl.[7] ..... A63F 3/00
(52) U.S. Cl. ..... 273/274; 463/13; 273/292
(58) Field of Search ..... 273/274, 236; 463/12, 13

(56) References Cited

U.S. PATENT DOCUMENTS 4,651,997 A * 3/1987 Wood
5,308,065 A * 5/1994 Bridgeman
5,328,189 A * 7/1994 Malek
5,437,462 A * 8/1995 Breeding
5,813,673 A * 9/1998 Richardson
6,102,402 A * 8/2000 Scott

OTHER PUBLICATIONS

Scarne's Draw poker chapter 2, pp. 6–32.*
Scarne's Blackjack Chapter 16, pp. 276–290.*

* cited by examiner

*Primary Examiner*—Benjamin H. Layno
*Assistant Examiner*—Vishu K Mendiratta
(74) *Attorney, Agent, or Firm*—Marshall, Gerstein & Borun

(57) ABSTRACT

In methods for playing wagering games, a player places a wager and a dealer deals two cards to the player. Instead of cards, other indicators selected or dealt from a set of indicators including a plurality of indicators bearing indicia designating a series of ordered rank, such as dice, or numbered tokens may be employed. The player is then afforded the opportunity to inspect the two cards and discard and replace zero, one, or two of the cards. After the discard option, the dealer reveals a third card and resolves the player's wager dependent on whether a predetermined winning relationship exists between the first, second, and third cards.

14 Claims, 2 Drawing Sheets

METHODS FOR PLAYING WAGERING GAMES

This application is based upon a provisional application filed on Jul. 23, 1999 with a Ser. No. of 60/145,555, and is hereby incorporated by reference.

BACKGROUND OF THE INVENTION

1. Field of the Invention

The present invention relates to wagering games, and more particularly pertains to wagering games of the type adapted for play at live table and video machine versions in casinos, card rooms, in Internet casinos, and on personal computers.

2. Description of the Prior Art

In a prior art wagering game known by the various names of In-Between, Yablon and Acey- Deucey, players play against each other in a banking card game in which players are each dealt two cards each, and then bet against an amount in a communal pot whether a third card will fall between the two cards. The game is described in *Scarne's Encyclopedia of Card Games* ©1973, 1983 John Scarne Games, Inc.) at page 315, a copy of which is filed with the instant application and incorporated herein by this reference thereto.

U.S. Pat. No. 4,651,997, issued to Michael W. Wood on Mar. 24, 1987, discloses a method for playing a card game using at least four standard decks of playing cards wherein a player places a wager, a dealer deals two cards face up to the player, the player places a second wager, the dealer deals a third card face up to the player, and if the third cards is of a rank between the first two cards, the dealer pays the player an equal amount on the first and second wagers according to posted odds. The entire disclosure of the foregoing patent is hereby incorporated herein by this reference thereto.

SUMMARY OF THE INVENTION

The present invention provides methods for playing wagering games. in which a player places a wager and a dealer deals two cards to the player. Instead of cards, other indicators selected or dealt from a set of indicators including a plurality of indicators or bearing indicia designating a series of ordered rank, such as dice, or numbered tokens may be employed. The player is then afforded the opportunity to inspect the two cards and discard and replace zero, one, or two of the cards. After the discard option, the dealer reveals a third card and resolves the player's wager dependent on whether a predetermined winning relationship exists between the first, second, and third cards.

These and various other advantages and features of novelty which characterize the invention are pointed out with particularity in the claims annexed hereto and forming a part hereof However, for a better understanding of the invention, its advantages, and the objects obtained by its use, reference should be made to the drawings which form a further part hereof,and to the accompanying descriptive matter, in which there is illustrated and described preferred embodiments of the invention.

DETAILED DESCRIPTION OF THE PREFERRED EMBODIMENT(S)

Figure 1:
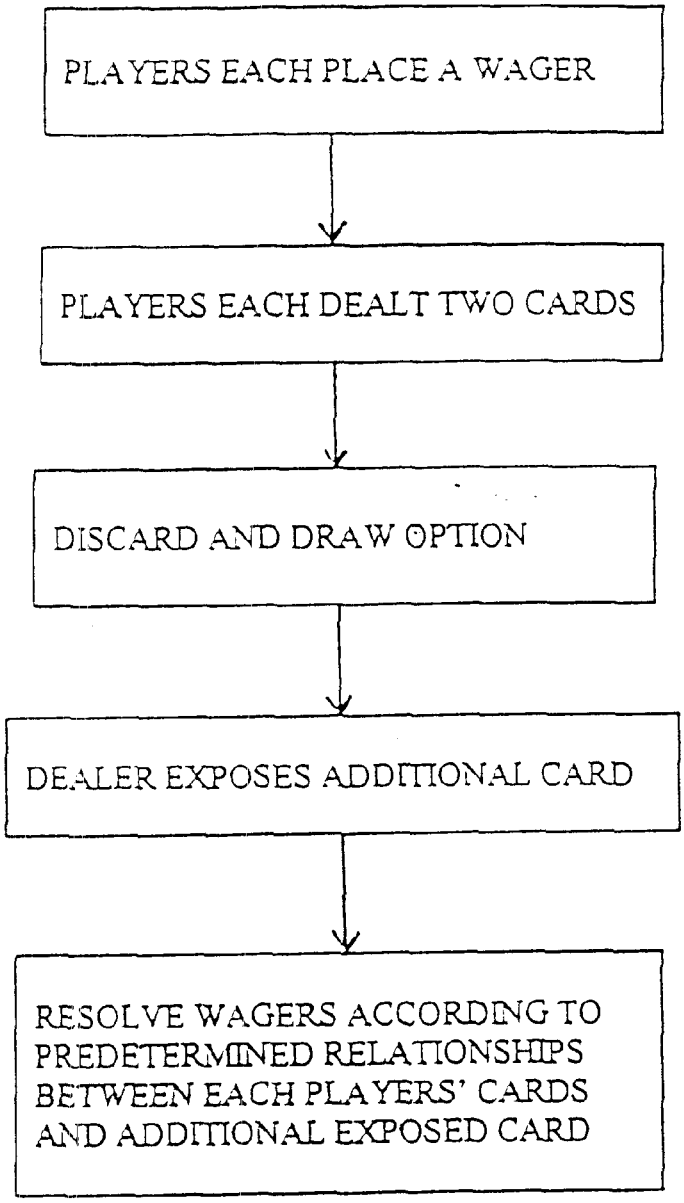
FIG. 1 is a flow chart illustrating the steps in playing a wagering game according to an example embodiment of the present invention.
Figure 2:
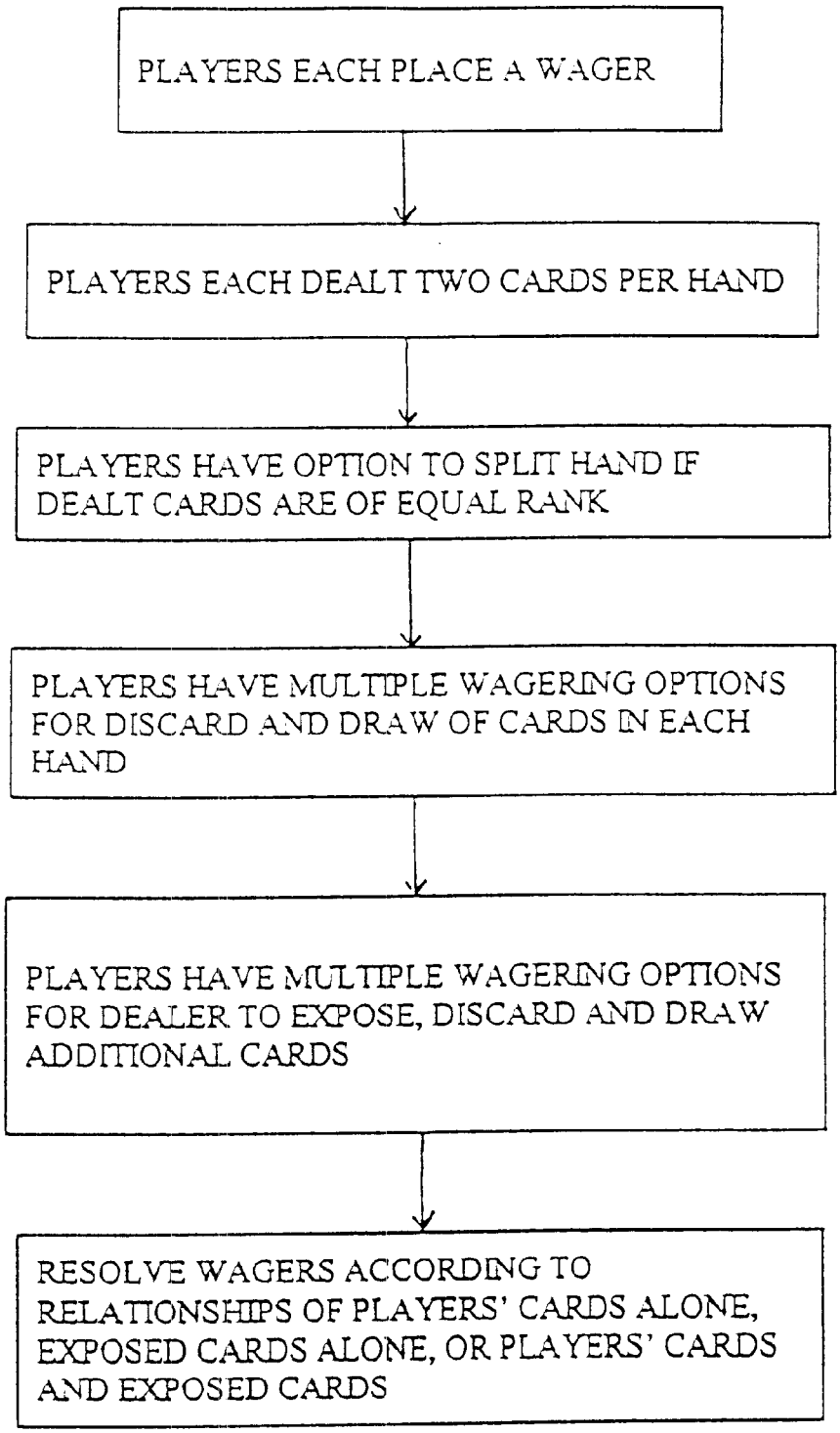
FIG. 2 is a flow chart illustrating the steps in playing a wagering game according to another preferred embodiment which can be considered but one possible modification to the first preferred embodiment.

Referring now to FIG. 1, a method of playing a wagering game according to an example embodiment of the invention will be described. In a card game embodiment of the invention, a single fifty-two card standard deck of playing cards may be employed. Alternatively, a plurality of standard decks may be shuffled together, as is a common practice in casino versions of Twenty-One.

The game may be played by one or more players, in electronic video versions, on a personal computer, on the Internet, or in live casino table game versions. Instead of cards, other ranked tokens or indicators may be employed, such as dice or numbered tokens or tiles. Such ranked indicators or tokens may comprise tangible physical objects, or electronic representations appearing on an electronic video gaming device or computer monitor.

In a card game format, each of the one or more players is first afforded an opportunity to place a wager to participate in the game. Each player is then dealt two cards. After inspecting their cards, each player is afforded an option to discard one or both cards and draw one or two new cards. The dealer then exposes an additional cards, and each player's wager is resolved depending upon whether the player's two cards and the additional exposed card form a predetermined winning relationship. Various predetermined winning relationships which may be employed include same card rank, same card suit, same card rank and suit, numeric sequence card rank, the additional exposed card having a rank falling between the ranks of the two player's cards, the additional exposed card having a rank equal to the sum of the rank of the player's two cards, and the additional exposed card having a rank equal to the difference of the rank of the player's two cards. A player's wagers are preferably paid according to a predetermined pay table in which various different predetermined card relationships win various amounts dependent on the amount of the wager. For example, a pay table listing various winning relationships and associated pay off odds may be employed. Alternatively, the wagers and winning amounts may be a fixed amount.

The present invention contemplates several variants and modified embodiments of the inventive game, as set forth below. The various alternative options discussed herein may be employed alone, or in any combination or permutation.

Splitting Pairs

If a player obtains two cards having the same rank, the player has the option to split the two cards into two separate hands by placing an additional wager and receiving additional cards, in a manner analogous to the manner of splitting pairs in conventional Twenty-One.

Additional Exposed Cards

As another option, players may be afforded the opportunity to place multiple wagers and receive multiple additional exposed cards. In this variation, a player plays their two card hand independently against each of the plurality of exposed cards, and settles the wagers dependent on whether a predetermined winning card relationship is obtained between the player's two cards and each of the separate additional exposed cards. In play of the game with a plurality of players, the exposed cards may be communal, with each player playing their two card hand with the same exposed card or cards. Alternatively, each player may be dealt their own separate, different exposed card or cards. If a plurality of exposed cards are employed, a winning card relationship may be based upon the poker rank, rank, suit, sum, difference, or other mathematical relationship of the plurality of exposed cards.

Draw Exposed Cards

In addition to, or as an alternative to player's being afforded an option to draw their own cards, a player may be afforded an option to discard and draw the exposed card or cards.

Wild Cards

One or more cards, such as ajoker, may be designated as a wild card. A wild card may take the place of a card of any suit or rank selected by the player receiving the wild card.

Side Bets

In addition to the wager resolved based upon whether a predetermined winning relationship exists between the player's two cards and the exposed card, additional side bet wager options may be provided. For example, players may be provided the option of placing a wager of whether the exposed card or cards are a predetermined winning card or have a predetermined relationship with other exposed cards (in the event that multiple exposed cards are employed). For instance, players might wager whether the exposed card has a rank higher or lower than a certain rank, or whether the exposed card is a certain card suit, or combination of suit and rank. Alternatively, or in addition, a side bet wager might be based upon whether the combination of the player's card and the exposed card have a predetermined winning relationship. For example, Ace, King, Queen suited. The side bet might be won based upon the sum, difference, or other mathematical relationship between the player's card and the exposed card or cards. A plurality of various different side bet options may be provided in the same game. In a live casino version of the game, a printed felt layout or table covering may be provided with indicia designating the various possible side bets, pay off odds, and provide locations for players to place chips to indicate their participation in a particular side bet.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts or types of material within the principles of the invention to the full extent indicated by the broad general meaning of the terms in which the appended claims are expressed.

What is claimed is:

1. A method of playing a card game, comprising:

receiving a wager from a player;

dealing only two cards to the player;

affording the player an option to discard one of the two cards or to discard both of the two cards;

dealing exactly one replacement card to the player if the player exercised the option to discard one of the two cards so that the player has two remaining cards after the one replacement card is dealt;

dealing exactly two replacement cards to the player if the player exercised the option to discard both of the two cards so that the player has two remaining cards after the two replacement cards are dealt;

exposing exactly one additional card; and determining whether the two remaining cards and the exposed additional card have a predetermined winning relationship.

2. The method of claim 1, further comprising replacing the exposed additional card with another card in response to a request by the player to discard the exposed additional card.

3. The method of claim 1, further comprising designating one or more cards as wild cards.

4. The method of claim 1, further comprising receiving a side bet from the player.

5. The method of claim 1, wherein determining whether the two remaining cards and the exposed additional card have a predetermined winning relationship includes comparing a rank of the exposed additional card to the two remaining cards.

6. The method of claim 5, wherein comparing the rank of the exposed additional card to the two additional cards includes performing a mathematical operation and comparing a result of the mathematical operation to the rank of the exposed additional card.

7. A method of playing a wagering game, comprising:

receiving a wager from a player;

dealing exactly two tokens having rank indicia to the player;

affording the player an option to discard one of the two tokens or to discard both of the two tokens;

dealing exactly one replacement token to the player if the player exercised the option to discard one of the two tokens so that the player has two remaining tokens after the one replacement token is dealt;

dealing exactly two replacement tokens to the player if the player exercised the option to discard both of the two tokens so that the player has two remaining tokens after the two replacement tokens are dealt;

exposing exactly one additional token; and determining whether the two remaining tokens and the exposed additional token have a predetermined winning relationship.

8. The method of claim 7, further comprising replacing the exposed additional token with another token in response to a request by the player to discard the exposed additional token.

9. The method of claim 7, further comprising designating one or more tokens as wild tokens.

10. The method of claim 7, further comprising receiving a side bet from the player.

11. The method of claim 7, wherein determining whether the two remaining tokens and the exposed additional token have a predetermined winning relationship includes comparing a rank of the exposed additional token to the two remaining tokens.

12. The method of claim 11, wherein comparing the rank of the exposed additional token to the two additional tokens includes performing a mathematical operation and comparing a result of the mathematical operation to the rank of the exposed additional token.

13. A method of playing a card game, comprising:

receiving a wager from a player;

dealing only first and second cards to the player;

dealing exactly two additional cards to the player if the first and second cards have the same rank and if the player requests the first and second cards to be split into two separate hands;

affording, the player an option to discard cards;

dealing replacement cards to the player if the player exercised the option to discard cards so that the player has one or two pairs of remaining cards;

exposing an additional card to the player; and determining if the one or both of the one or two pairs of remaining cards and the exposed additional card have a predetermined winning relationship.

14. A method of playing a card game, comprising:

receiving a wager from a player;

electronically displaying only two cards to the player;

affording the player an option to discard one of the two cards or to discard both of the two cards;

electronically displaying exactly one replacement card to the player if the player exercised the option to discard one of the two cards so that the player has two remaining cards after the one replacement card is dealt;

electronically displaying exactly two replacement cards to the player if the player exercised the option to discard both of the two cards so that the player has two remaining cards after the two replacement cards are dealt;

electronically displaying exactly one additional card; and determining whether the two remaining cards and the one additional card have a predetermined winning relationship.

* * * * *